US006704036B2

(12) United States Patent
Hayashi et al.

(10) Patent No.: US 6,704,036 B2
(45) Date of Patent: Mar. 9, 2004

(54) COLOR THERMAL PRINTER

(75) Inventors: Shinji Hayashi, Saitama (JP); Hisashi Enomoto, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/439,190

(22) Filed: May 16, 2003

(65) Prior Publication Data

US 2003/0214569 A1 Nov. 20, 2003

(30) Foreign Application Priority Data

May 16, 2002 (JP) ..... 2002-141190

(51) Int. Cl.[7] ..... B41J 2/36
(52) U.S. Cl. ..... 347/175; 347/173; 347/188
(58) Field of Search ..... 400/120.09; 347/188, 347/183, 195, 173, 175

(56) References Cited

U.S. PATENT DOCUMENTS 5,142,300 A * 8/1992 Aoki ..... 347/183
5,841,459 A * 11/1998 Wen ..... 347/176
5,886,724 A * 3/1999 Kuwabara et al. ..... 347/188
6,091,436 A * 7/2000 Kuwabara ..... 347/195
6,108,019 A * 8/2000 Katsuma et al. ..... 347/188

FOREIGN PATENT DOCUMENTS

JP 2002-067370 A 3/2002

* cited by examiner

*Primary Examiner*—Huan Tran
(74) *Attorney, Agent, or Firm*—Sughrue Mion, PLLC

(57) ABSTRACT

A color thermal printer has thermal heads for recording yellow, magenta and cyan mono-color image, respectively. An mono-color image data of each mono-color image is processed in image data processing section, and thereafter sent to the thermal head. A correction CPU for each mono-color image reads out mono-color image data at each line to calculate a transport friction fluctuation at the thermal head between recording line and a first previous line thereto. Further, the correction CPU calculates a correction of heat energy of the thermal head on the basis of all of the transport friction fluctuation of the thermal heads.

11 Claims, 8 Drawing Sheets

COLOR THERMAL PRINTER

BACKGROUND OF THE INVENTION

1. Field of the Invention

The present invention relates to a color thermal printer having plural thermal heads for respective colors, which prints plural full-color images on a continuous recording paper.

2. Description Related to the Prior Art

A thermal printer, such as a thermosensitive color priner, is well known, in which a thermal head heats a thermosensitive recording paper having a thermosensitive coloring layer to record a mono-color image. The thermal head has plural heat elements arranged in a main-scanning direction. In the thermal printer, the thermosensitive recording paper is transported in a sub-scanning direction relatively to the thermal head, and thereby a mono-color image is recorded line by line. Each heat element is driven on the basis of image data of pixel for each line, to apply a print energy (or heat energy) to the thermosensitive recording paper.

A friction coefficient between the thermosensitive recording paper and the thermal head varies in accordance with the total heat energy for one line. When the total heat energy becomes higher, then the temperature of the heat elements increases, and therefore the friction coefficient becomes smaller. When the total heat energy becomes lower, then the temperature of the heat elements decreases and therefore the friction coefficient becomes larger. Accordingly, when the color density of the original image varies suddenly, then the variation of the heat energy is so large that the friction coefficient varies suddenly. When the friction coefficient varies, then the transport friction between the thermosensitive recording paper and the thermal head varies, and therefore the transport speed of the thermosensitive recording paper varies. Accordingly, the heat energy applied to a unit area varies, which causes the printed mono-color image to have unevenness.

The Japanese Patent Laid-Open Publication No. 2002-67370, for example, discloses a thermal printer, in which the mono-color image is printed without unevenness although the transport friction varies in accordance with the heat energy. In the thermal printer, the transport friction of the thermal head is calculated at each line, and a transport load fluctuation, or a transport friction fluctuation, between a recording line and previous recorded line is calculated from each transport friction. Then, image data for the recording line of the mono-color image is corrected on the basis of the transport friction fluctuation. Thus, although unstableness of the transport friction fluctuates the transport speed, the heat energy for each heat element is adjusted in accordance with the change of the transport speed. Therefore it is prevented to generate the unevenness in the printed mono-color image.

By the way, a color thermal printer is known. In the color thermal printer is used a color thermosensitive recording paper having a cyan, a magenta, and a yellow coloring layer on the base in this order. The color thermal printer prints a full-color image on the color thermosensitive recording paper. There is a type of the color thermal printer, in which the continuous color thermosensitive recording paper is transported to form the full-color images sequentially in plural print areas. In a transport path, yellow, magenta and cyan thermal heads are disposed in this order, and yellow, magenta and cyan images are simultaneously printed in the different print areas with the respective yellow, magenta and cyan thermal heads. Thus the plural full-color images are formed sequentially.

However, in the color thermal printer, when the above-described adjusting method of the heat energy is applied to each thermal head, the occurence of unevenness of each mono-color image in the variation of the transport friction cannot be prevented. In the color thermal printer, the transport friction fluctuation at the one thermal head has influences on the printing of the each mono-color image with other thermal head. For example, when the transport friction varies at the yellow thermal head, then the transport speed of the color thermosensitive recording paper varies. Accordingly, not only the yellow image but also the magenta and cyan images have unevenness.

SUMMARY OF THE INVENTION

An object of the present invention is to provide a color thermal printer in which it is prevented that variation of a friction of a thermal head causes unevenness of coloring when plural mono-color images are recorded with thermal heads.

In order to achieve the object and the other object, a color thermal printer of the present invention includes first-$N^{th}$ thermal heads having plural heat elements, first-$N^{th}$ platen rollers confronting to the first-$N^{th}$ thermal heads respectively, and a calculation means. Each of the heat elements arranged in a main-scanning direction is driven on a basis of a corrected mono-color image data to apply a heat energy for coloring to a coloring layer of a color thermosensitive recording paper. The calculation means calculates a friction between each thermal head and the color thermosensitive recording paper on the basis of the heat energy corresponding to a mono-color image data at each thermal head. Further, the calculation means calculates a transport friction fluctuation of the frictions between the recording line and a first previous line. Then the mono-color image data of the $K^{th}$ thermal head is adjust on the basis of all of the transport friction fluctuation of the first-$N^{th}$ thermal heads to become the corrected mono-color image data, while K satisfies $1 \leqq K \leqq N$.

In the color thermal printer, the calculation means may be provided with first-$N^{th}$ calculation sections for calculating the transport friction fluctuation of the first-$N^{th}$ thermal heads. The first-$N^{th}$ calculation section further has first-$N^{th}$ memories for memorizing the transport friction fluctuation of the first-$N^{th}$ thermal heads respectively.

Further, in the thermal printer, the number N is three, and the first, second, and third thermal heads are yellow, magenta and cyan thermal heads. When the yellow thermal head starts one line recording earlier by $P\,(0 \leqq P \leqq 1)$ line than the magenta thermal head, then the transport friction fluctuation FY(M) of the yellow thermal head satisfies a following formula:

$$FY(M)=Fy(M)+P\times(Fm(M-1))+(1-P)\times Fm(M).$$

In the formula, Fy(M) is a transport friction fluctuation by a yellow thermal head when $M^{th}$ line recording is made. Fm(M−1) is a transport friction fluctuation by a magenta thermal head when $(M-1)^{th}$ line recording is made. Fm(M) is a transport friction fluctuation by a magenta thermal head when $M^{th}$ line recording is made.

According to the color thermal printer of the present invention, the first-$N^{th}$ thermal heads are driven to record respective mono-color images on continuous color recording sheet almost at the same time and to print full-color images sequentially. The calculation means provided in the thermal printer calculates a transport friction fluctuation at each thermal head, and the heat energy of each thermal head is adjusted on the basis of all of the transport friction fluctuations. Accordingly, it is prevented that the unstableness of the friction of each thermal head causes the unevenness in the full-color image.

BRIEF DISCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
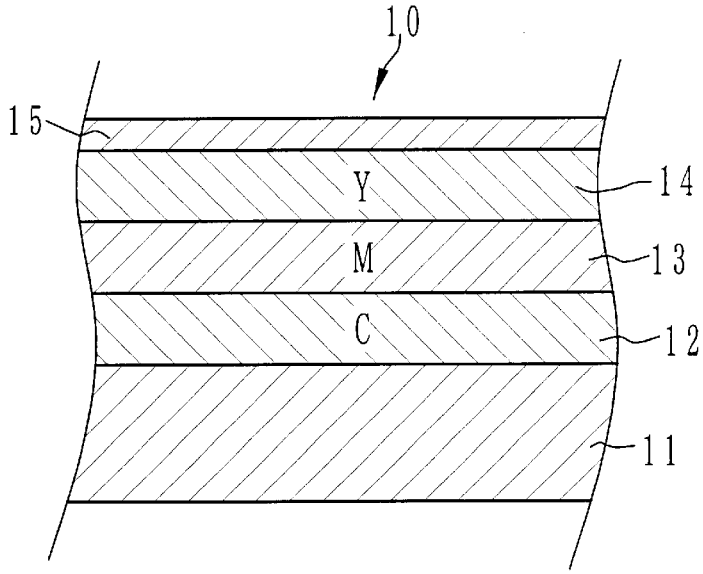
FIG. 1 is a sectional view of a color thermosensitive recording paper.

In FIG. 1, a color thermosensitive recording paper 10 has a base 11, a cyan coloring layer 12, a magenta coloring layer 13, a yellow coloring layer 14, and a protective layer 15. The cyan, magenta, yellow coloring layers 12–14 are overlaid on the base 11 in this order, and have a heat coloring property. The yellow coloring layer 14 is an uppermost recording layer. The thermal recording is performed downwards from the uppermost coloring layer, sequentially. Therefore, the first thermal recording is performed in the yellow coloring layer 14. It is to be noted that, if it is designated that thermal recording is performed in order of magenta, yellow and cyan, then the positions of the yellow coloring layer 14 and the magenta coloring layer 13 are exchanged. Further, the color thermosensitive recording paper may be provided with a specific coloring layer, for example, a black coloring layer.

The yellow coloring layer 14 and the magenta coloring layer 13 have an optical fixing property so as to be fixed in illumination of a fixing light in respective predetermined ranges of wavelength. When the yellow coloring layer 14 is illuminated in a yellow fixing UV-ray whose peak is about 420 nm, then the yellow coloring layer 14 loses the coloring property. When the magenta coloring layer 13 is illuminated in a magenta fixing UV-ray whose peak is about 365 nm, then the magenta coloring layer 13 loses the coloring property.

The protective layer 15 is a transparent resin layer and disposed on the yellow coloring layer 14 in order to prevent the scratch on the coloring layers 12–14. Note that intermediate layers are provided between the coloring layers 12–14. However, they are omitted in the drawing.

Figure 2:
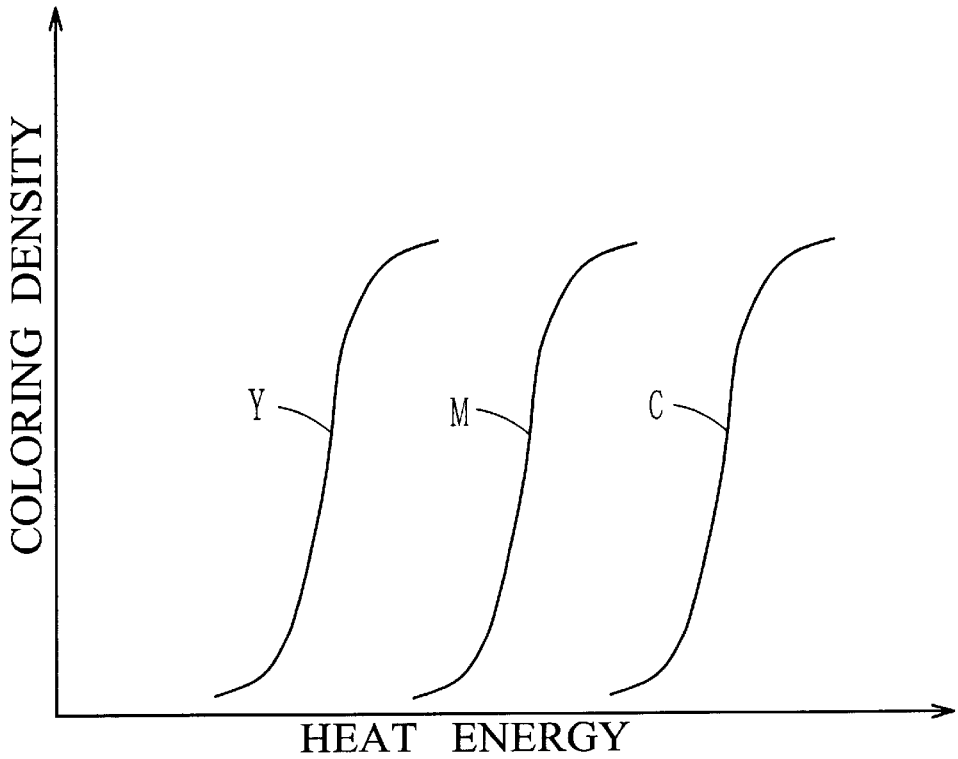
FIG. 2 is a graph illustrating a coloring property of the color thermosensitive recording paper.

FIG. 2 illustrates curves Y, M, C of the heat coloring properties of the yellow, magenta and cyan coloring layers 14, 13, 12, respectively. Heat energy necessary for coloring becomes larger gradually from the yellow coloring layer 14 to the cyan coloring layer 12, namely, from the uppermost to the lowest layer in the color thermosensitive recording paper 10.

Figure 3A:
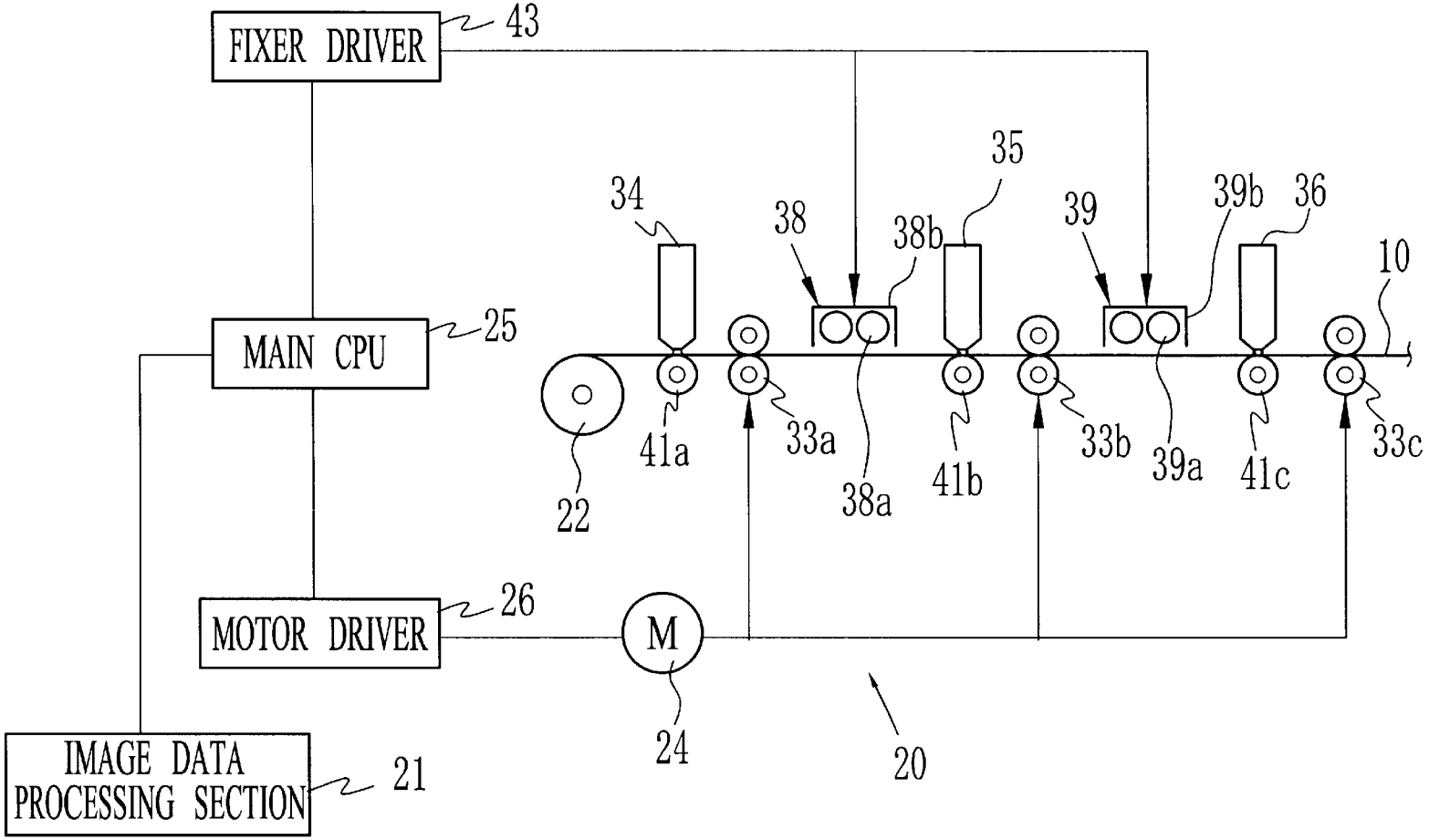
FIG. 3A is a schematic diagram of a color thermal printer of the present invention.

As shown in FIG. 3A, a roll of the continuous color thermosensitive recording paper 10 is set as a recording sheet roll 22 in a color thermal printer 20. The color thermosensitive recording paper 10 is unwound from the recording sheet roll 22 and fed in a transport path. In the transport path, roller pairs 23*a*, 23*b*, 23*c* are disposed for nipping and transporting the color thermosensitive recording paper 10. The roller pairs 23*a*, 23*b*, 23*c* are driven by a transport motor 24. As the transport motor 24, a pulse motor is used, whose rotation number is determined in accordance with the number of drive pulses (or drive signals), for example.

The color thermal printer 20 has a main CPU and a motor driver 26. The main CPU 25 controls the rotation number of the transport motor 24 through the motor driver 26. The motor driver 26 sends the drive pulses to the transport motor 24, and the transport motor 24 rotates at a predetermined speed. Thereby, the main CPU 25 counts the number of the drive pulses, and controls the rotation of the transport motor 24 on the basis of the counted number. Thus the continuous color thermosensitive recording paper 10 is transported in a direction A1 in the transport path.

The color thermal printer 20 further includes plural thermal heads, namely a yellow thermal head 34, a magenta thermal head 35 and a cyan thermal head 36 for performing the coloring in yellow, magenta, cyan respectively. The thermal heads 34–36 are arranged in the direction A1 in the transport path, and actuated simultaneously to record thereby three mono-color images, yellow, magenta and cyan images, in different print areas at the same time. While the continuous color thermosensitive recording paper 10 is transported, the print area confronts to the yellow, magenta, cyan thermal heads 34–36 in this order, and the yellow, magenta, cyan images are recorded sequentially to print the full-color image. Thereafter, the print area is further fed to a cutter (not shown), and cut off from the continuous color thermosensitive recording paper 10 with the cutter to be a print having a predetermined size. The print is discharged from the color thermal printer 20.

In each of the thermal heads 34–36, plural heat elements are arranged in a main-scanning direction to construct a heat element array. When in recording each mono-color image, the heat element array is pressed to the color thermosensitive recording paper 10. Then the heat element array is actuated on basis of mono-color image data for one line, and each heat element applies the heat energy to the color thermosensitive recording paper 10 in accordance with coloring density of mono-color image data for each color. Thus, the color thermosensitive recording paper 10 is heated and each mono-color image is recorded line by line. Further, the thermal heads 34–36 are confronted to platen rollers 31*a*, 31*b*, 31*c* respectively. The platen rollers 31*a*, 31*b*, 31*c* bases the color thermosensitive recording paper 10 pressed with the confronting thermal heads 34, 35, 36.

The color thermal printer 20 further has a yellow fixer 38, a magenta fixer 39 and a fixer driver 43. The yellow fixer 38 is constructed of lamps 38*a* for irradiating the yellow fixing UV-ray and a reflector 38*b*, and disposed between the yellow and magenta thermal heads 34, 35 to fix the yellow coloring layer 14 after recording the yellow image. The magenta fixer 39 is constructed of lamps 39*a* for irradiating the magenta fixing UV-ray and a reflector 39*b*, and disposed between the magenta and cyan thermal heads 35, 36 to fix the magenta coloring layer after recording the magenta image. The yellow and magenta fixers 38, 39 are driven by the fixer driver 43.

Figure 3B:
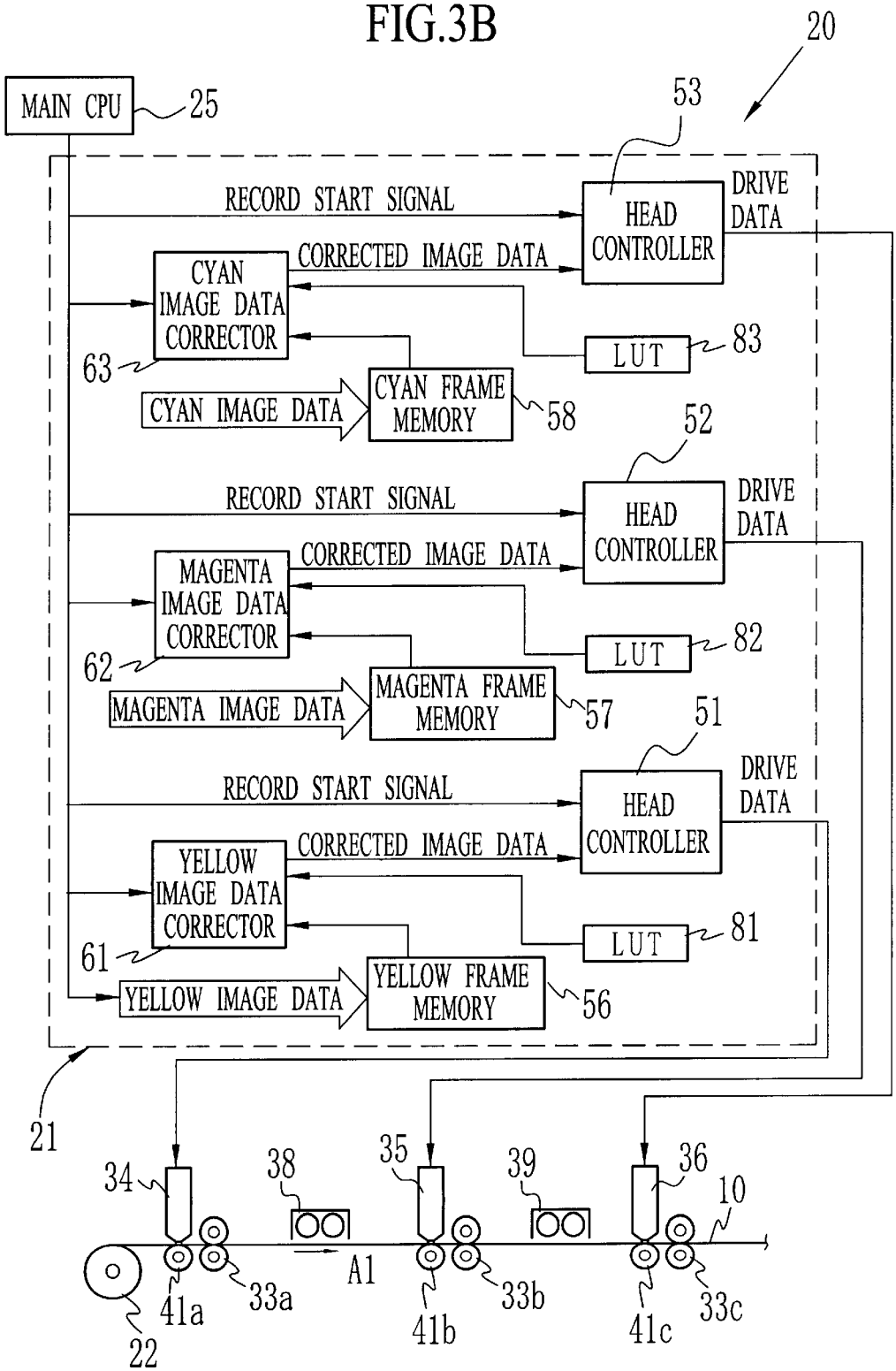
FIG. 3B is a block diagram illustrating a drive circuit for thermal heads.

The color thermal printer 20 is provided with an image processing section 21. As shown in FIG. 3B, the image processing section 21 includes yellow, magenta, cyan frame memories 56, 57, 58 in which the mono-color image data of yellow, magenta, and cyan images are written respectively. Thereafter, the correction processing of the mono-color image data is carried out in image data correctors 61, 62, 63. The image data correctors 61, 62, 63 send the corrected mono-color image data to respective head controllers 51, 52, 53 responding to signals sent from the main CPU 25.

The main CPU 25 is connected to the head controllers 51–53 for respectively controlling the yellow thermal head 34, the magenta thermal head 35, and the cyan thermal head 36. The main CPU 25 sends the head controllers 51–53 a record start signal for each line. Responding to the record start signal, the head controllers 51–53 drives the thermal heads 34, 35, 36.

Figure 4:
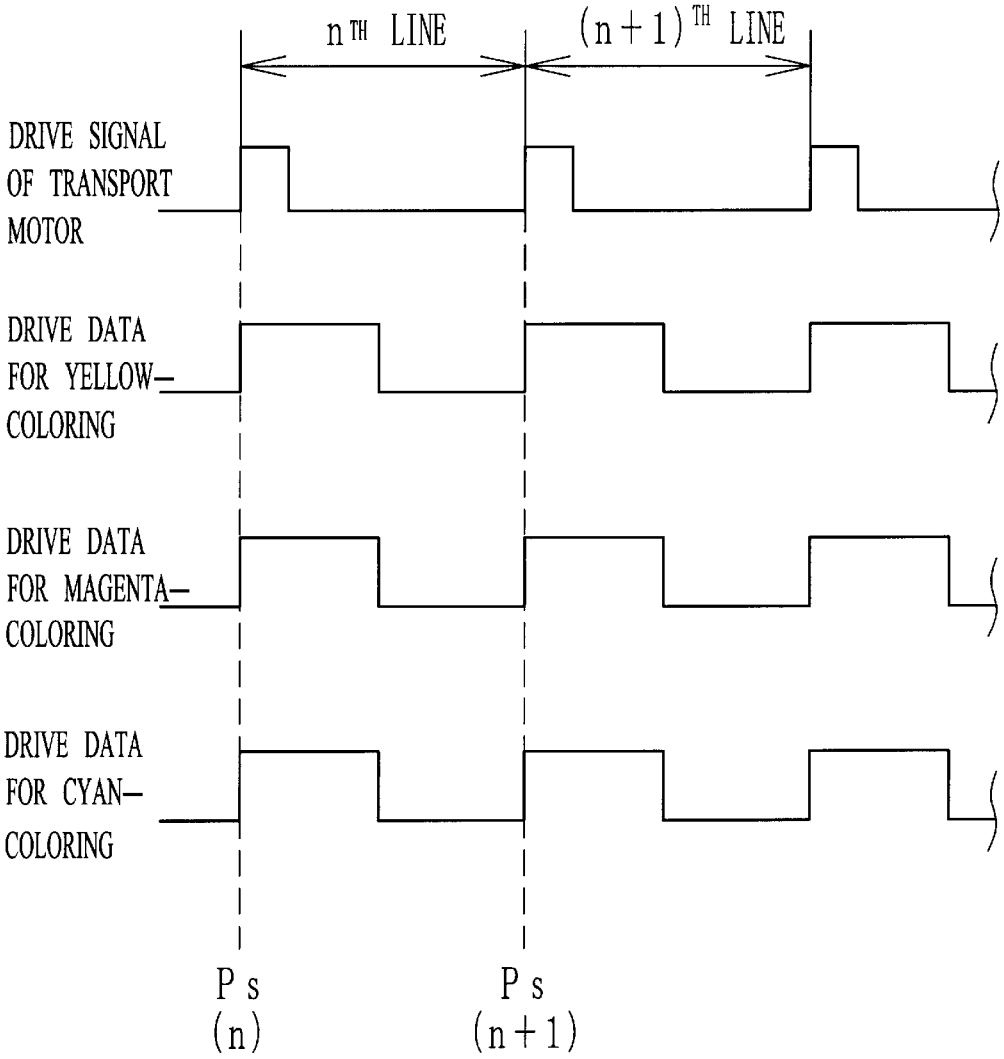
FIG. 4 is an explanatory view illustrating a record start timing of each mono-color image.

The head controllers 51–53 generate drive data for driving the heat elements on the basis of the corrected mono-color image data sent from the image data correctors 61–63, respectively. The drive data determines the time of applying current to each heat element to make a gradation in the mono-color image to be recorded. In FIG. 4, the indication Ps is record start timing for starting recording. The main CPU 25 sends each head controller 51–53 the record start signal, synchronized with the drive signal of the transport motor 24. The head controllers 51–53 send the respective yellow, magenta and cyan thermal heads 34–36 the drive data to drive heat elements.

Figure 5:
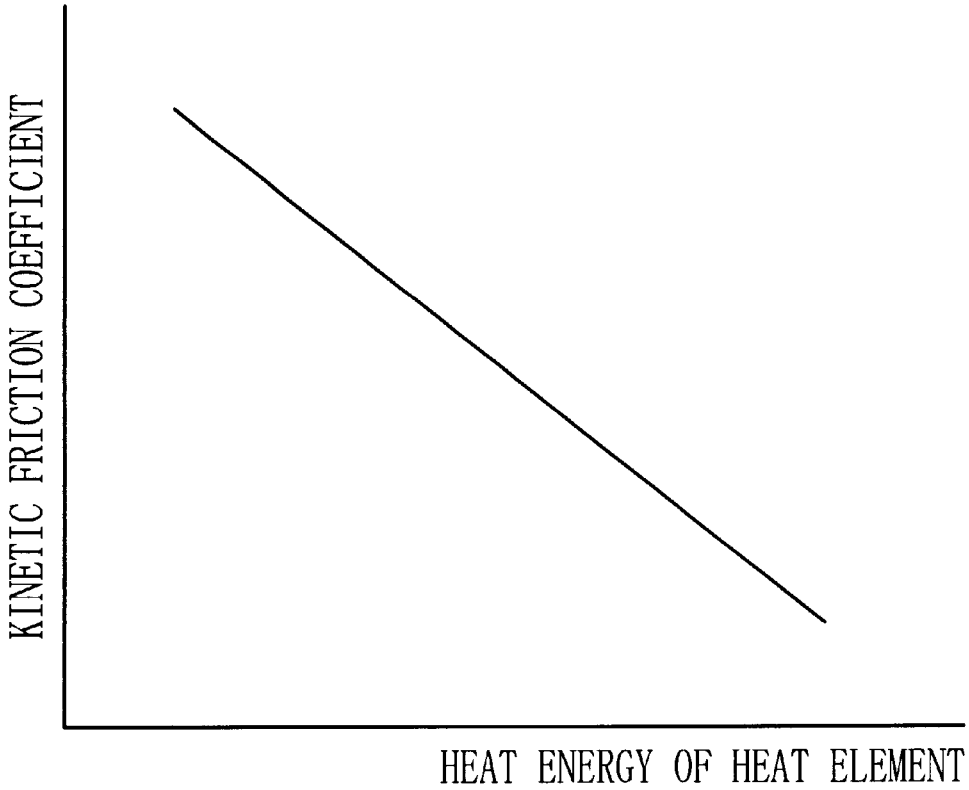
FIG. 5 is a graph illustrating a relation of heating energy and kinetic friction coefficient of the color thermosensitive recording paper.

As show in FIG. 5, when the heat elements generate the larger heat energy, the kinetic friction coefficient of the thermal heads 34, 35, 36 to the thermosensitive color recording paper becomes smaller. Accordingly, the transport friction at each thermal head 34, 35, 36 fluctuates in accordance with the heat energy. When the fluctuation of the transport friction in each thermal head 34, 35, 36 is extremely large, then the transport speed of the color thermosensitive recording paper 10 becomes more variable.

For example, when the thermal head records a high density area after a low density area, then the transport friction becomes smaller immediately, and therefore the transport speed of the color thermosensitive recording paper 10 becomes high at one time. Accordingly, the thermosensitve color-recording sheet 10 receives the heat energy less on the recording line than the expected one. Therefore, the density of the recording line is decreased. Otherwise, when the thermal head records a low density area after a high density area, then the transport friction becomes larger immediately, and therefore the transport speed of the color thermosensitive recording paper 10 becomes low at one time. Accordingly, the thermosensitve color-recording sheet 10 receives the heat energy more on the recording line than the expected one. Therefore, the density of the recording line is increased. In order to decrease the influences of the fluctuation of the transport friction on recording the each mono-color image, an image data correction, or a correction of mono color image data, is performed in the image data correctors 61, 62, 63.

Figure 6:
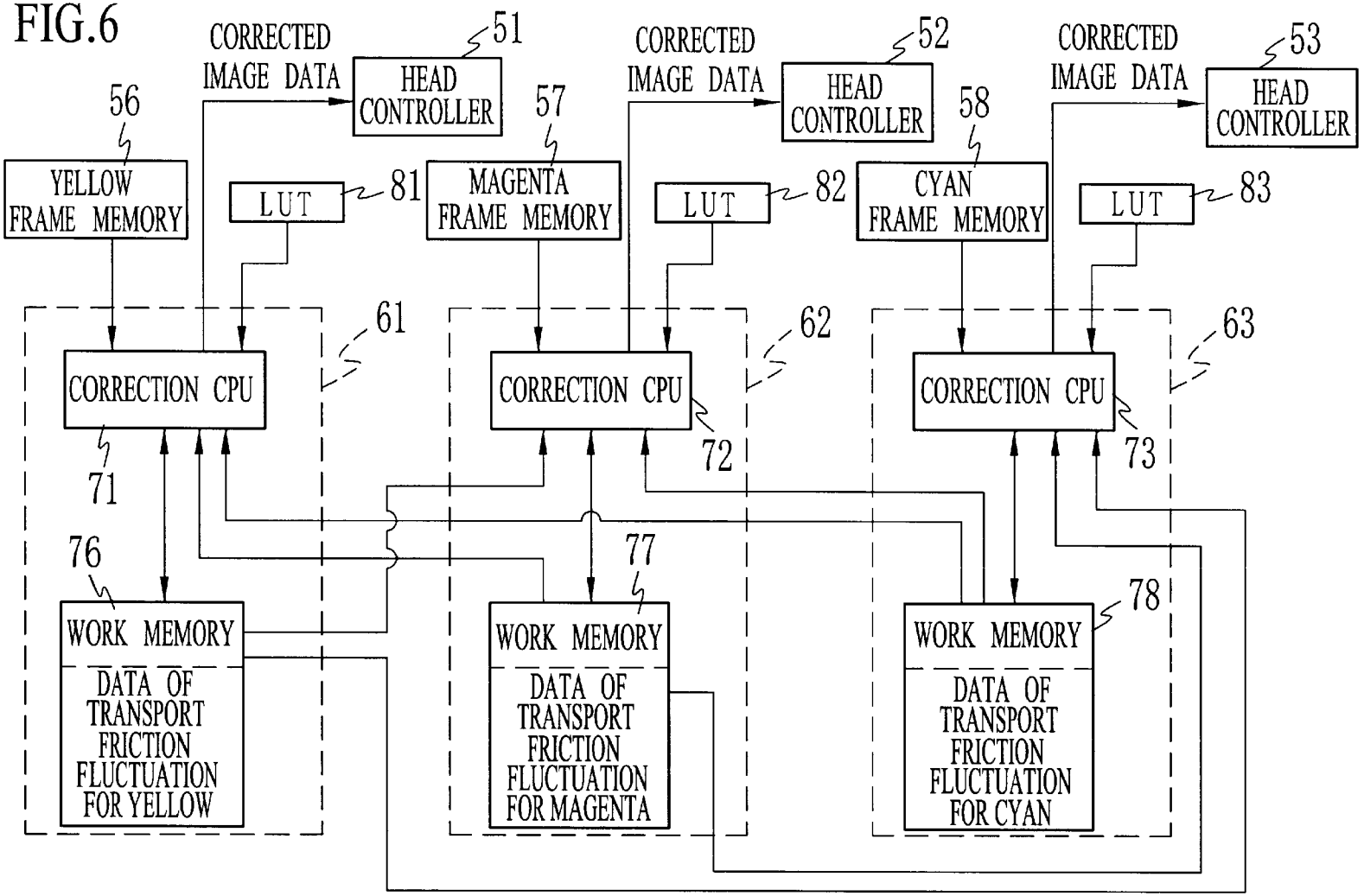
FIG. 6 is a block diagram of processing data of each mono-color image in the color thermal printer.

In FIG. 6, the image data correctors 61, 62, 63 have correction CPUs 71, 72, 73, and work memories 76, 77, 78. Each correction CPU 71, 72, 73 is connected with all of the work memories 76, 77, 78. Furhter, the correction CPUs 71, 72, 73 are connected to LUTs 81, 82, 83, respectively. In each LUT 81, 82, 83 are memorized an energy transform table, a pressing force distribution table, a kinetic friction coefficient table and the like. The energy transform table is a table in which the address is a gradation of the mono-color image data and corresponds to a data of the heat energy to be applied from the heat elements to the color thermosensitive recording paper 10. The pressing force distribution table is a table in which the address is each heat element and corresponds to the data of pressing force of each heat element applied to the color thermosensitive recording paper 10. The kinetic friction coefficient table is a table representing a relation between the heat energy and the kinetic friction coefficient of the color thermosensitive recording paper 10 as shown in FIG. 5.

Figure 7:
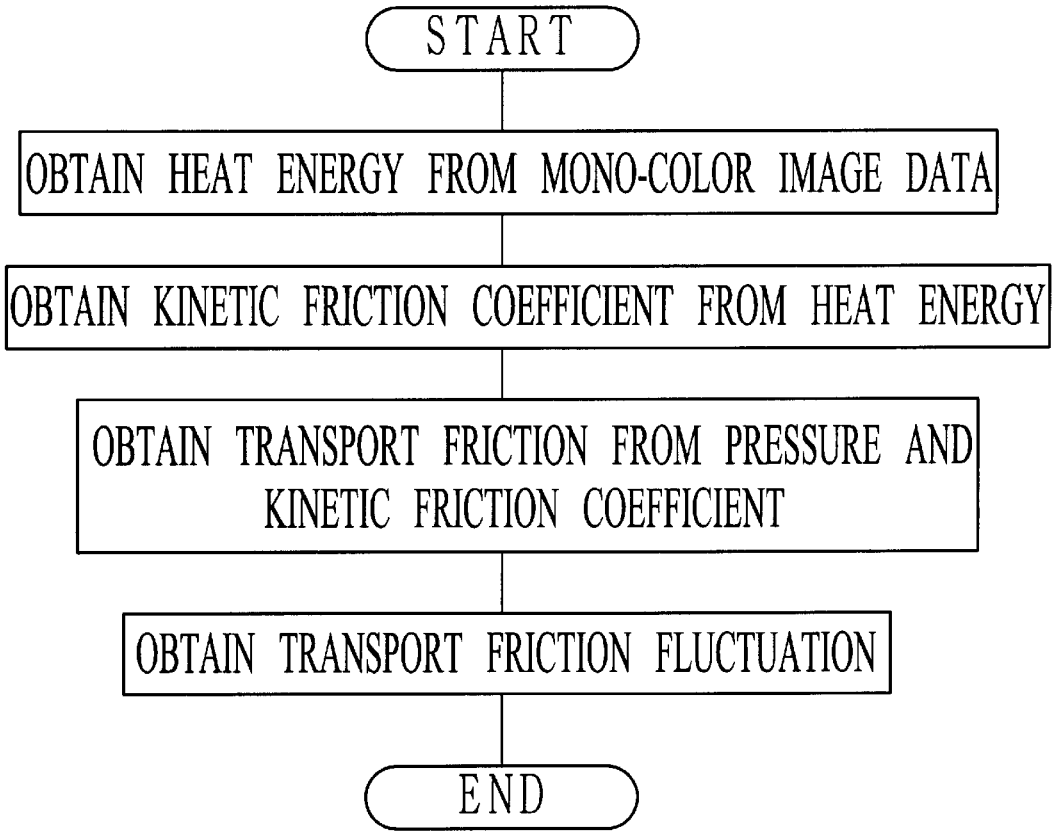
FIG. 7 is a flow chart illustrating a process of calculating a friction at each recording line.

As shown in FIG. 7, the correction CPUs 71, 72, 73 obtain the amount of the transport load fluctuation, or the transport friction fluctuation, at each thermal head 34, 35, 36 for each line. First, the correction CPU 71, 72, 73 obtains the heat energy from the mono-color image data of one line in reference with the energy transform table. Secondly, the kinetic friction coefficient is obtained from the heat energy in reference with the kinetic friction coefficient table. Further, the kinetic friction coefficient is multiplied to the pressing force which is obtained in reference with the pressing force distribution table. Thus the transport friction as transport load at each thermal head 34, 35, 36 is obtained. At last, the amount of the transport friction fluctuation F is obtained from the amount of the transport frictions between the recording line to be printed and the first previous line.

Further, as the thermal heads 34–36 performs the printing almost simultaneously, the transport friction fluctuation F at each thermal head 34–36 has an influence on the simultaneous recording with the others. For example, supposing that the transport friction at the yellow thermal head 34 becomes larger and that of the magenta thermal head 35 becomes smaller simultaneously. In this case, the amount of the transport of the color thermosensitive recording paper 10 becomes smaller at the yellow thermal head 34, and the amount of the transport of the color thermosensitive recording paper may become larger at the magenta thermal head 35. When the former decreasing the amount of the transport at the thermal head 34 and the latter decreasing the amount of the transport at the thermal head 35 are equal, then the color thermosensitive recording paper 10 can be transported adequately.

Accordingly, it is necessary that each correction CPU 71, 72, 73 adjusts the heat energy on the basis of the transport friction fluctuations F calculated in all of the correction CPU 71, 72, 73. The correction CPU 71, 72, 73 calculate the transport friction fluctuations F, which is constructed of yellow, magenta and cyan transport friction fluctuations Fy, Fm, Fc. The yellow transport friction fluctuation Fy is memorized in the work memory 76, the magenta transport friction fluctuation Fm is memorized in the work memory 77, and the cyan transport friction fluctuation Fc is memorized in the work memory 78. In each of the work memories 76–78, data of the transport friction fluctuation for plural lines are memorized. For example, not only the transport friction fluctuation of the recording line but also that of the previous recorded two lines and that of the following two lines are memorized. The data of the transport friction fluctuation for the most previous recorded line is updated with that for the new line when one line is recorded.

As reading out all of the yellow, magenta and cyan transport friction fluctuations Fy, Fm, Fc from the work memories 76, 77, 78, respectively, each correction CPU 71, 72, 73 can calculate a correction of the mono-color image data in the recording line of each mono-color image, on the basis of the transport friction fluctuation. For example, the correction CPU 71 for the yellow image reads out the transport friction fluctuations Fm, Fc from the work memories 77, 78 for magenta and cyan images, respectively. Thus, in the correction CPU 71, all of the transport friction fluctuations Fy, Fm, Fc are input. The correction CPU 71 calculates a correction of the yellow image data in the recording line of the yellow image on the basis of all of the transport friction fluctuations Fy, Fm, Fc.

It is necessary that the calculation for the correction of each mono-color image data should be made line by line. There are many steps for making the calculation. In order to make such calculation with a single CPU, calculation speed thereof must be high, and it is hard to decrease the cost. In the above embodiment, the correction CPU is provided for each thermal head so as to separately process the calculation for each mono-color image data. Accordingly, the calculation speed of the correction CPU must not be high in the above embodiment. Further, the time for processing can be easily shorter.

Figure 8:
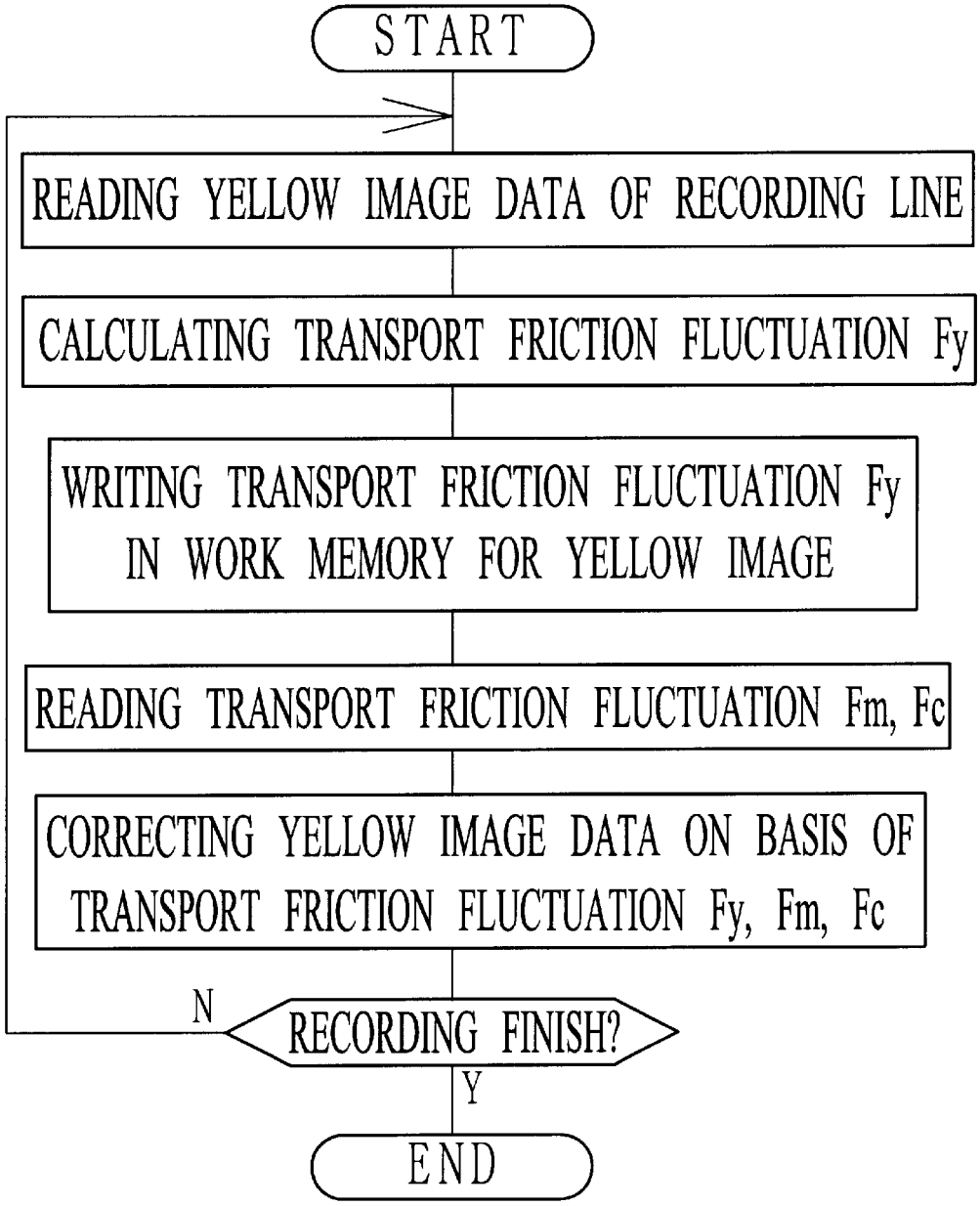
FIG. 8 is a flow chart illustrating a process of correcting the data of the mono-color image.

Operation of the above embodiment will be explained with reference to FIG. 8. This figure illustrates the correction process of the yellow image data. The correction processes according to the magenta and cyan image data are omitted as they are the same as to the yellow image data.

When the color thermosensitive recording paper 10 is transported and the print area reaches the yellow thermal head 34, then the yellow thermal head 34 makes the thermal recording of the yellow image. Thereafter, in the print area the yellow coloring layer is fixed, and the print area is fed to the magenta thermal head 35 to record the magenta image. Then the magenta coloring layer is fixed, and the print area is further fed to the cyan thermal head 36, while other recording layers reach the yellow and magenta thermal heads such that yellow and magenta images may be recorded at the same time as the cyan image. Thus three primary color images are recorded in the respective print areas simultaneously, and the plural full-color images are printed in the same print area sequentially.

In order to record the yellow image, the yellow image data corrector 61 reads out yellow image data for one line from the frame memory 56. The correction CPU 71 reads out the tables from the LUT 81 to obtain the transport friction fluctuation Fy as the process in FIG. 7. The transport friction fluctuation Fy is written in the work memory 76. Otherwise, the magenta image data corrector 62 and the cyan image data corrector 63 obtain the respective transport friction fluctuation Fm, Fc, in the same process to write them in the work memories 76, 77.

The correction CPU 71 for the yellow image reads out the transport friction fluctuations Fm, Fc from the work memory 77 for the magenta image and the work memory 78 for the cyan image, respectively. Then the correction CPU 71 calculates the correction on the basis of the transport friction fluctuations Fy, Fm, Fc to correct the yellow image data. The corrected yellow image data is sent to the head controller 51 for the yellow image. The head controller 51 generates a drive data from the corrected yellow image data to drive the yellow thermal head 34. The heat elements of the yellow thermal head 34 are heated in accordance with the drive data. As each yellow image data is corrected on the basis of total of the transport friction fluctuations Fy, Fm, Fc, the heat energy generated from each heat element of the yellow thermal head 34 is adjusted adequately, and the yellow image is recorded without unevenness.

It is to be noted that, the magenta image data corrector 62 and the cyan image data corrector 63 correct the respective magenta and cyan image data on the basis of all of the transport friction fluctuations Fy, Fm, Fc in the same method as yellow image data corrector 61.

In the above embodiment, the yellow, magenta and cyan thermal heads are synchronized to record the respective mono-color image. However, they may not to be synchronized. In this case, it is preferable to consider the difference of the record start timing (or phase difference) between the thermal heads for adjusting the heat energy.

When the drive of the thermal heads are not synchronized, then the main CPU 25 inputs the yellow, magenta and cyan image data corrector 61, 62, 63 the record start signals of the respective thermal heads. The yellow, magenta and cyan image data corrector 61, 62, 63 calculate the phase difference of the record timing from the record start signal.

When there is a phase difference, the transport friction fluctuation of the one thermal head influences on the recording of the other thermal head in other plural lines. For example, the record start timing of the yellow thermal head 34 is earlier than the magenta thermal head 35. In this case, the transport friction fluctuation at recording the $n^{th}$ line with the magenta thermal head 35 influences on recording the $n^{th}$ line and $(n+1)^{th}$ line with the yellow thermal head 34. Accordingly, it is necessary to calculate a secondary correction, in which the effects of the influences are separated in accordance with the phase difference to adjust the heat energy at the $n^{th}$ and $(n+1)^{th}$ recording lines.

As the data of the transport friction fluctuations of lines previous and following to the recording line is memorized in the work memories 76, 77, 78, the correction CPU 71 for the yellow image calculates the secondary correction of the yellow image data for the recording line on the basis of the transport friction fluctuation of three color images and the phase differences.

For example, the phase difference is +0.3 line between the yellow thermal head 34 and the magenta thermal head 35, namely, the record timing of the yellow thermal head 34 is earlier than the record timing of the magenta thermal head 35 by time corresponding to 0.3 line. When Sy(n) and Sy(n+1) are the total corrections for the yellow thermal head 34 at recording the $n^{th}$ line and $(n+1)^{th}$ line, then the total corrections Sy(n) and Sy(n+1) are represented as follows.

$$Sy(n)=(\text{Main correction at } n^{th} \text{ line for yellow image})+0.3\times(\text{Correction at } (n-1)^{th} \text{ line for magenta image})+0.7\times(\text{Correction at } n^{th} \text{ line for magenta image})$$

$$Sy(n+1)=(\text{Main correction at } n^{th} \text{ line for yellow image})+0.3\times(\text{correction at } n^{th} \text{ line for magenta image})+0.7\times(\text{Correction at } (n+1)^{th} \text{ line for magenta image})$$

In order to obtain the total correction Sy(n), the correction CPU 71 for the yellow image calculates the correction (main correction) based on the transport friction fluctuation of the yellow thermal head 34 for the $n^{th}$ line. Further, the correction CPU 72 for magenta image calculates the corrections (main correction) for the $(n-1)^{th}$ and $n^{th}$ lines, and writes them in the work memory 77 for magenta image. Then, the CPU 71 reads out the magenta corrections for $(n-1)^{th}$ and $n^{th}$ lines from the work memory 77. As the phase difference corresponds to +0.3 line, the magenta correction for the $n^{th}$ line is multiplied to 0.3, and that for the $(n-1)^{th}$ line is multiplied to 0.7 by the CPU 71. Thereafter, these multiplied values as secondary corrections and the yellow correction for the $n^{th}$ line as the main correction are added to obtain the total correction Sy(n) by the CPU 71.

In order to obtain the total correction Sy(n+1), the correction CPU 71 for the yellow image calculates the correction based on the transport friction fluctuation of the yellow thermal head 34 for the $(n+1)^{th}$ line. Then, the correction CPU 71 reads out from the work memory 77 the corrections according to the magenta image for the $n^{th}$ and $(n+1)^{th}$ lines, which the correction CPU 72 for magenta image has calculated and written in the work memory 77. As the phase difference corresponds to +0.3 line, the correction of the magenta image for the $(n+1)^{th}$ line is multiplied to 0.3, and that for the $n^{th}$ line is multiplied to 0.7. Thereafter, these multiplied values according to the magenta image and the correction according to the yellow image for the $(n+1)^{th}$ line are added to obtain the total correction Sy(n+1).

In the above explanation, the yellow thermal head is taken an example. The explanations for the magenta and cyan thermal heads are omitted as they are the same as the yellow thermal head. Further, in the above explanation, only the relation of the yellow thermal head to the magenta thermal head is considered for simplicity. However, when there is a phase difference between the yellow thermal head and the cyan thermal head, then the transport friction fluctuation must be considered.

Accordingly, when there is a phase difference of the record timing between the plural thermal head, the adjustment of the heat energy can be made. Thus the color registration may be prevented due to the phase difference.

In the above embodiment, each mono-color image data corrector is provided with the LUT and the work memory. However, the thermal printer may have the one LUT and the one work memory which are connected with the plural image data correctors.

Further, in the above embodiment, the number of the thermal heads is three. However, the present invention is not restricted in it, and may have plural, for example, four thermal heads.

Further, in the above embodiment, the transport friction fluctuations of the three thermal heads are controlled with the three correction CPUs. However, the thermal printer of the present invention may include the one correction CPU for controlling all the transport friction fluctuations of the three thermal heads.

In the above embodiment, the present invention is applied to the color thermosensitive printer. However, the present invention can be applied to a sublimating type color thermal printer and wax transfer type color thermal printer. In each printer of these types, an ink ribbon is disposed between a continuous recording paper and thermal heads, and ink or dye of the ink ribbon is transferred to the recording paper.

Various changes and modifications are possible in the present invention and may be understood to be within the present invention.

What is claimed is:

1. A color thermal printer for printing full-color images in a continuous color thermosensitive recording paper in which first-$N^{th}$ coloring layers are formed on a base for respectively coloring, N mono-color images being recorded in different print areas of said color thermosensitive recording paper almost simultaneously to print said full-color images sequentially, said color thermal printer comprising:

first-$N^{th}$ thermal heads provided for said respective first-$N^{th}$ coloring layers, each of said first-$N^{th}$ thermal heads having plural heat elements which are arranged in a main-scanning direction, each heat element contacting to said color thermosensitive recording paper, and being driven on a basis of corrected mono-color image data to apply a heat energy for coloring to said coloring layer, and to record said mono-color image line by line;

first-$N^{th}$ platen roller confronting to said first-$N^{th}$ thermal heads respectively for supporting said color thermosensitive recording paper pressed by said first-$N^{th}$ thermal heads; and a calculation means to calculate for each line a friction between each thermal head and said color thermosensitive recording paper on basis of a heat energy corresponding to a mono-color image data at each thermal head, and to calculate a transport friction fluctuation according to said frictions between a recording line and a first previous line, said mono-color image data of said $K^{th}$ thermal head being adjusted on the basis of all of said transport friction fluctuations of first-$N^{th}$ thermal heads to become said corrected mono-color image data of said $K^{th}$ thermal head, while K satisfies $1 \leqq K \leqq N$.

2. A color thermal printer as claimed in claim 1, wherein said calculation means includes first-$N^{th}$ calculation sections for calculating said transport friction fluctuation of said first-$N^{th}$ thermal heads, and first-$N^{th}$ memories for memorizing said transport friction fluctuations of said first-$N^{th}$ thermal heads, respectively.

3. A color thermal printer as claimed in claim 2, wherein timing for starting one line recording is the same between said first-$N^{th}$ thermal heads.

4. A color thermal printer as claimed in claim 2, wherein there is a phase difference of timing for starting one line recording between said first-$N^{th}$ thermal heads, and each of said calculation sections calculates said corrected mono-color image data in consideration of said phase difference.

5. A color thermal printer as claimed in claim 2, wherein the number N is three.

6. A color thermal printer as claimed in claim 5, wherein said first, second, and third coloring layers are yellow, magenta and cyan coloring layers, and said first, second and third thermal heads are yellow, magenta and cyan thermal heads.

7. A color thermal printer as claimed in claim 6, wherein, when said yellow thermal head starts one line recording earlier by P ($0 \leqq P \leqq 1$) line than the magenta thermal head, then said transport friction fluctuation FY(M) of said yellow thermal head for $M^{th}$ line satisfies a following formula:

$$FY(M)=Fy(M)+P\times(Fm(M-1))+(1-P)\times Fm(M)$$

Wherein

Fy(M) is a transport friction fluctuation by a yellow thermal head when $M^{th}$ line recording is made;

Fm(M−1) is a transport friction fluctuation by a magenta thermal head when $(M-1)^{th}$ line recording is made; and Fm(M) is a transport friction fluctuation by a magenta thermal head when $M^{th}$ line recording is made.

8. A color thermal printer for printing full-color images in a continuous recording paper of which first-$N^{th}$ mono-color images are recorded in different print areas almost simultaneously to print said full-color images sequentially, said color thermal printer comprising:

first-$N^{th}$ thermal heads provided for said respective first-$N^{th}$ color images, each of said first-$N^{th}$ thermal heads having plural heat elements which are arranged in a main-scanning direction, and being driven on a basis of corrected mono-color image data to apply a heat energy to record said mono-color image line by line;

first-$N^{th}$ platen roller confronting to said first-$N^{th}$ thermal heads respectively for supporting said recording paper pressed by said first-$N^{th}$ thermal heads; and a calculation means to calculate for each line a friction between each thermal head and said recording paper on basis of a heat energy corresponding to a mono-color image data at each thermal head, and to calculate a transport friction fluctuation according to said frictions between a recording line and a first previous line, said mono-color image data of said $K^{th}$ thermal head being adjusted on the basis of all of said transport friction fluctuations of first-$N^{th}$ thermal heads to become said corrected mono-color image data of said $K^{th}$ thermal head, while K satisfies $1 \leqq K \leqq N$.

9. A color thermal printer as claimed in claim 8, wherein said calculation means includes first-$N^{th}$ calculation sections for calculating said transport friction fluctuation of said first-$N^{th}$ thermal heads, and first-$N^{th}$ memories for memorizing said transport friction fluctuations of said first-$N^{th}$ thermal heads, respectively.

10. A color thermal printer as claimed in claim 9, wherein timing for starting one line recording is the same between said first-$N^{th}$ thermal heads.

11. A color thermal printer as claimed in claim 9, wherein there is a phase difference of timing for starting one line recording between said first-$N^{th}$ thermal heads, and each of said calculation sections calculates said corrected mono-color image data in consideration of said phase difference.

* * * * *